US010590937B2

(12) United States Patent
Goodfellow et al.

(10) Patent No.: US 10,590,937 B2
(45) Date of Patent: Mar. 17, 2020

(54) COMPRESSED AIR SYSTEM AND METHOD OF OPERATING SAME

(71) Applicant: Toyota Motor Engineering & Manufacturing North America, Inc., Erlanger, KY (US)

(72) Inventors: John A. Goodfellow, Waterloo (CA); Jodie S. Mels, Waterford (CA); Robert J. Coveney, Brantford (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 691 days.

(21) Appl. No.: 15/096,398

(22) Filed: Apr. 12, 2016

(65) Prior Publication Data

US 2017/0292522 A1 Oct. 12, 2017

(51) Int. Cl.

| | |
|---|---|
| ***F04D 15/00*** | (2006.01) |
| ***F04D 13/12*** | (2006.01) |
| ***F04D 15/02*** | (2006.01) |
| ***F04C 28/06*** | (2006.01) |
| ***F04D 25/16*** | (2006.01) |

(52) U.S. Cl.

CPC ..... *F04D 15/0066* (2013.01); *F04C 28/065* (2013.01); *F04D 13/12* (2013.01); *F04D 15/029* (2013.01); *F04D 15/0281* (2013.01); *F04D 25/16* (2013.01); *F04B 2203/0214* (2013.01); *F04C 2270/56* (2013.01)

(58) Field of Classification Search

CPC ..... F04D 15/0066; F04D 15/0281; F04D 15/029; F04D 25/16; F04D 13/12; F04C 28/065; F04C 2270/56; F04B 2203/0214

USPC ..... 417/2, 5, 7, 8

See application file for complete search history.

(56) References Cited

U.S. PATENT DOCUMENTS 2,225,291 A * 12/1940 Alderson ..... F04B 49/00 417/7
4,580,947 A * 4/1986 Shibata ..... F04B 49/022 417/38
4,951,475 A * 8/1990 Alsenz ..... F25B 49/022 417/7

(Continued)

OTHER PUBLICATIONS

Mehltretter, "Applying Variable Speed Compressors in Multiple Applications—Application Success Stories and Improvement Stories", Retrieved from the Internet: <http://airbestpractices.com/technology/air-compressors/applying-variable-speed-compressors-multiple-applications-application-suc>, Retrieved Sep. 16, 2015, (10 pages).

*Primary Examiner* — Christopher S Bobish
(74) *Attorney, Agent, or Firm* — Christopher G. Darrow; Darrow Mustafa PC

(57) ABSTRACT

An improved compressed air system utilizes one or more base compressors, such as fixed speed drive compressors, to meet the compressed air demands and one or more trim compressors, such as variable speed drive compressors, to meet the variations in the demand. The operation of both the base and trim compressors may be controlled to provide improved overall efficiency while meeting the transient load demands. The control may spread the demands over the various base compressors to improve the overall loading on each base compressor. Efficiency metrics may be utilized to control the switching between base and trim compressors. Unloading of a base compressor may be controlled to avoid undesirable changes in system performance.

16 Claims, 10 Drawing Sheets

(56) References Cited

U.S. PATENT DOCUMENTS

| | | | | |
|---|---|---|---|---|
| 5,190,442 | A * | 3/1993 | Jorritsma | F04D 15/0083 417/12 |
| 5,265,434 | A * | 11/1993 | Alsenz | F25B 49/022 62/117 |
| 5,327,742 | A * | 7/1994 | Duff | F25B 49/022 236/1 EA |
| 5,343,384 | A * | 8/1994 | Fisher | F04B 49/022 417/8 |
| 5,797,729 | A * | 8/1998 | Rafuse, Jr. | F04B 49/20 417/3 |
| 6,287,083 | B1 * | 9/2001 | Hase | F04B 41/06 417/2 |
| 6,370,888 | B1 * | 4/2002 | Grabon | F04B 49/20 62/115 |
| 6,419,454 | B1 * | 7/2002 | Christiansen | F04B 49/065 417/12 |
| 6,579,067 | B1 * | 6/2003 | Holden | F04B 41/06 417/2 |
| 6,807,817 | B2 * | 10/2004 | Lee | F25B 13/00 417/7 |
| 7,207,183 | B2 * | 4/2007 | Crane | F25B 49/025 417/2 |
| 7,955,056 | B2 * | 6/2011 | Pettersson | F04B 41/06 417/2 |
| 8,192,171 | B2 * | 6/2012 | Mehaffey | F04B 49/20 417/2 |
| 9,599,118 | B2 * | 3/2017 | Zhou | F04B 27/14 |
| 2004/0193330 | A1 * | 9/2004 | Mehaffey | F04B 41/06 700/301 |
| 2004/0265133 | A1 * | 12/2004 | Lau | F04D 27/0261 417/7 |
| 2006/0099085 | A1 * | 5/2006 | Pancrazi | F04B 49/065 417/44.2 |
| 2015/0211518 | A1 | 7/2015 | Park et al. | |

* cited by examiner

| BASE Position | Initial Assignment | Post 1st Switch Assignment | Post 2nd Switch Assignment |
|---|---|---|---|
| 1 | Compressor A | Compressor B | Compressor C |
| 2 | Compressor B | Compressor C | Compressor D |
| 3 | Compressor C | Compressor D | Compressor A |
| 4 | Compressor D | Compressor A | Compressor B |

COMPRESSED AIR SYSTEM AND METHOD OF OPERATING SAME

FIELD

The subject matter described herein relates in general to compressed air systems and, more particularly, to an improved compressed air system and method of operating same.

BACKGROUND

Manufacturing and industrial plants typically utilize compressed air as an energy source that may be available throughout the plants. These plants use a compressed air system to provide the compressed air. The demand for compressed air is dynamic and may vary throughout the day and from day to day. Compressed air systems are typically sized (and often oversized) based on full load operating conditions and are designed to operate most efficiently at full load. These systems typically use Fixed Speed Drive (FSD) compressors, such as centrifugal compressors which may have one or more stages to achieve the rated full load output in an efficient manner. However, the demand on most compressed air systems varies throughout the day and the systems are often operating at less than full load. The loading may be adjusted based on throttling the input to the FSD compressors and any over production of compressed air may be removed by venting compressed air from the system through a blow-off valve. FSD compressors are inefficient at part loads and if not controlled properly a system could have several or all of its FSD compressors simultaneously running at part loads, crippling the overall efficiency. Additionally, venting of compressed air from the system is also inefficient.

Variable Speed Drive (VSD) compressors, such as variable speed screw compressors, use variable speed motors to modulate their output. The advantage of this is that it allows the compressor to have a relatively linear output (cubic feet per minute) to energy (kilowatt) input efficiency curve compared to other mechanisms such as inlet modulation and load/unload operation. This makes VSD compressors useful as trim compressors, supplying the variable demand on top of a stable base demand. However, VSD compressors are not as efficient as FSD compressors at providing a relatively constant output.

A compressed air system that uses both FSD compressors and VSD compressors, however, may result in operational situations where undesirable operation is occurring. Additionally, the FSD compressors may have a limited ability to be repeatedly started and stopped within a given time frame thereby limiting operational flexibility of the compressed air system.

SUMMARY

An improved compressed air system utilizes one or more base compressors, such as FSD compressors, to meet the compressed air demands and one or more trim compressors, such as VSD compressors, to meet the variations in the demand. The operation of both the base and trim compressors is controlled to provide improved overall efficiency while meeting the transient load demands. The control can spread the demands over the various base compressors to improve the overall loading on each base compressor. Efficiency metrics can be utilized to control the switching between base and trim compressors. Unloading of a base compressor can be controlled to avoid undesirable changes in system performance.

In one respect, the present disclosure is directed to a compressed air system having an air distribution network, a plurality of base compressors, at least one trim compressor and a control system. Each base compressor has an air outlet coupled to the air distribution network and operable to independently supply a flow of pressurized air to the air distribution network. The at least one trim compressor has an air outlet coupled to the air distribution network and operable to independently supply a flow of pressurized air to the air distribution network. The control system is coupled to the air distribution network, the base compressors, and the at least one trim compressor. The control system monitors the operating condition of the air distribution network and controls the operation of the base compressors and the at least one trim compressor to meet an air demand placed on the air distribution network. The base compressors are arranged an in initial use order that determines the order in which the base compressors will be activated by the control system and upon the deactivation of one of the base compressors the order of the base compressors is changed.

In another respect, the present disclosure is directed to a compressed air system having an air distribution network, a plurality of base compressors, at least one trim compressor and a control system. Each base compressor has an air outlet coupled to the air distribution network and operable to independently supply a flow of pressurized air to the air distribution network. The at least one trim compressor has an air outlet coupled to the air distribution network and operable to independently supply a flow of pressurized air to the air distribution network. The control system monitors the operating condition of the air distribution network and controls the operation of the base compressors and the at least one trim compressor to meet an air demand placed on the air distribution network. The control system replaces operation of one of the base compressors or the at least one trim compressor with operation of a respective trim compressor or base compressor when an efficiency metric exceeds a predetermined threshold.

In yet another respect, the present disclosure is directed to a compressed air system having an air distribution network, a plurality of base compressors, at least one trim compressor and a control system. Each base compressor has an air outlet coupled to the air distribution network and operable to independently supply a flow of pressurized air to the air distribution network. The at least one trim compressor has an air outlet coupled to the air distribution network and operable to independently supply a flow of pressurized air to the air distribution network. The control system monitors the operating condition of the air distribution network and controls the operation of the base compressors and the at least one trim compressor to meet an air demand placed on the air distribution network. When the control system determines that there is excess air production and seeks to stop operation of a base compressor, the control system initiates an unload test. The unload test includes reducing the output pressure of an operating base compressor by a predetermined increment in a series of steps and monitoring the pressure of the air distribution network relative to a predetermined threshold at each step. The control system stops operation of the associated base compressor if the pressure remains above the predetermined threshold and maintains operation of the associated base compressor if the pressure drops below the predetermined threshold.

DETAILED DESCRIPTION

Figure 1:
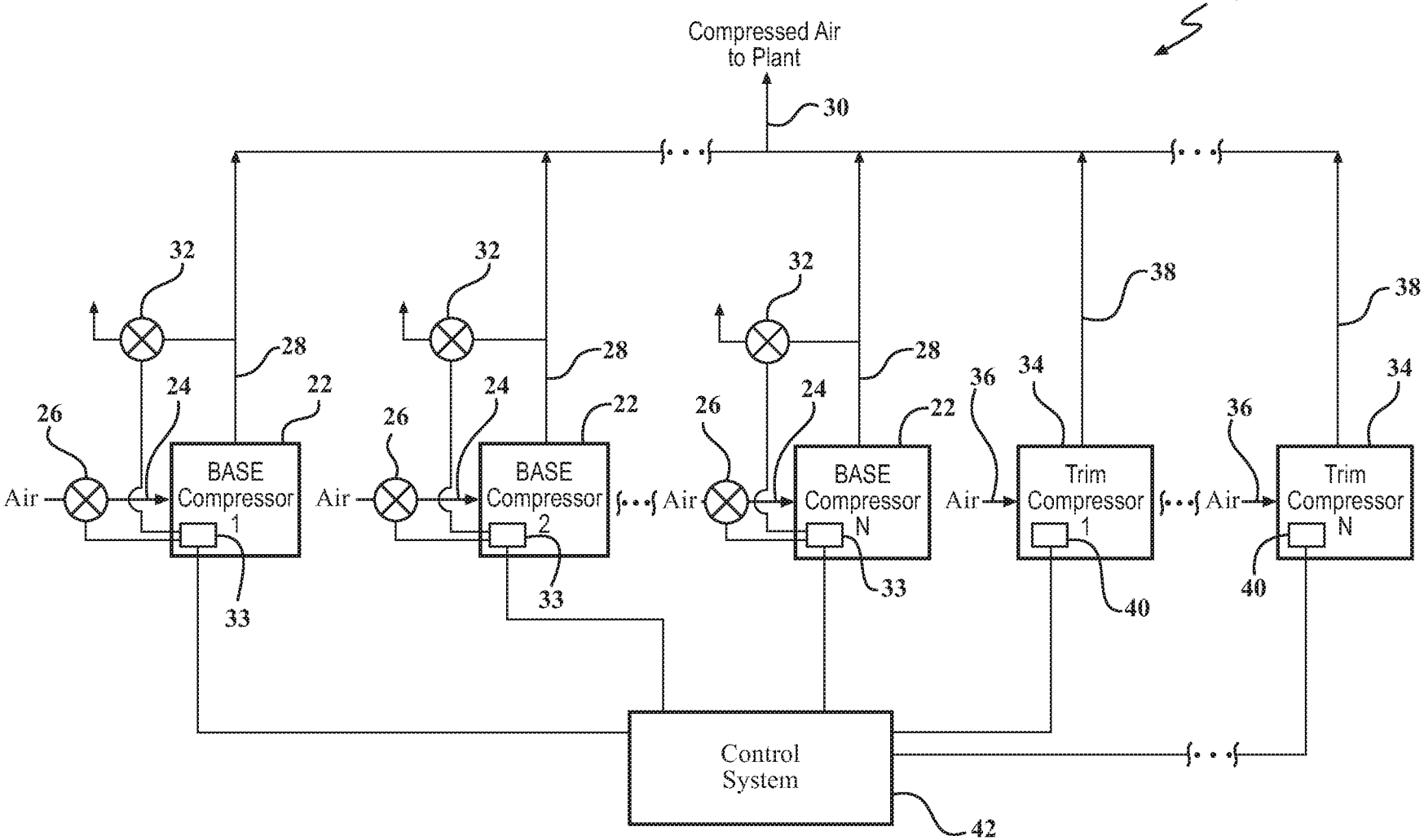
FIG. 1 is schematic representation of an example compressed air system with both base compressors and trim compressors.

This detailed description relates to compressed air systems that utilize one or more base compressors, such as FSD compressors, to meet the compressed air demands and one or more trim compressors, such as VSD compressors, to meet the variations in the demand. The operation of both the base and trim compressors may be controlled to provide improved overall efficiency while meeting the transient load demands. The control scheme may spread the demands over the various base compressors to improve the overall loading on each base compressor. Efficiency metrics may be utilized to control the switching between base and trim compressors. Unloading of a base compressor may be controlled to avoid undesirable changes in system performance.

Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in the Figures, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

In one or more arrangements, a compressed air system 20 may include a plurality of compressors to meet the air demand. System 20 may include a plurality of base compressors 22 which may be configured to provide a majority of the compressed air demand placed on system 20. Base compressors 22 may be fixed speed drive (FSD) compressors, such as multi-stage centrifugal compressors. Exemplary FSD compressors may include Ingersoll Rand CENTAC brand compressors available from Ingersoll Rand. Each base compressor 22 has an air inlet 24 which may have a throttling device 26 operable to throttle the air flow into base compressor 22. Each base compressor 22 has an air outlet 28 that is coupled to an air distribution network 30 of system 20. A blow-off device 32 may be operatively coupled to each outlet 28 to allow excess compressed air to be released. Blow-off devices 32 may be located adjacent the associated base compressor 22 or at a remote location. The number of base compressors 22 can vary based on the desired capacity system 20. As shown in FIG. 1, system 20 can include multiple base compressors 22 as numbered from 1 to N. Each base compressor 22 may have a same or different capacity than other ones of the base compressors 22. For example, base compressors 22 may have a capacity of 3000 CFM, 4000 CFM and 5500 CFM at a particular pressure, such as 112 psi. Accordingly, system 20 can have any number of base compressors 22 and any number of same or differing capacities. Each base compressor 22 may be operable to independently supply compressed air to air distribution network 30. Each base compressor 22 may include an associated controller 33 that is operable to turn base compressor 22 on/off and adjust operation of its associated throttling device 26 and blow-off device 32 to maintain desired operation (i.e., volume output of compressed air at a desired pressure) and meet the air demand placed on system 20.

System 20 may include one or more trim compressors 34 which may be configured to provide compressed air to supplement the compressed air provided by base compressors 22 to meet the air demand. Trim compressors 34 may be variable speed drive (VSD) compressors, such as screw compressors. Exemplary VSD compressors may include Ingersoll Rand Sierra brand and Atlas Copco ZR315 brand compressor available from Ingersoll Rand and Atlas Copco, respectively. Each trim compressor 34 has an air inlet 36 that supplies air to trim compressor 34. Each trim compressor 34 has an air outlet 38 that is coupled to an air distribution network 30 of system 20. As shown in FIG. 1, system 20 can include multiple trim compressors 34 as numbered from 1 to N. Each trim compressor 34 may have a same or different capacity than other ones of the trim compressors 34. For example, trim compressors 34 may have a capacity of 500 CFM, 1000 CFM, and 1500 CFM at a particular pressure, such as 112 psi. Accordingly, system 20 can have any number of trim compressors 34 and any number of same or differing capacities. Each trim compressor 34 may be operable to independently supply compressed air to air distribution network 30. Each trim compressor 34 may include an associated controller 40 that is operable to turn trim compressor 34 on/off and adjust its output based on varying the speed at which it is driven to maintain desired operation (i.e., volume output of compressed air at a desired pressure) and meet the air demand placed on system 20.

System 20 may include a master controller 42 that is operable to control the operation of system 20 to meet the air demand. Master controller 42 may be operatively connected to each base compressor 22, trim compressors 34, and the associated components, such as throttling devices 26 and blow-off devices 32. For example, in some arrangements master controller 42 may be connected to base controllers 33 and trim controllers 40 to command and control the operation of system 20 while in other arrangements master controller 42 may alternatively or in addition be directly connected to each component of system 20 to command and control the operation of system 20. Accordingly, the specific arrangement and connections of the controllers can be varied as desired. Additionally, while operation of the various components of system 20 may be referred to with reference to a particular controller, such as base controller 33, trim controller 40 and/or master controller 42, it should be appreciated that the particular reference is merely exemplary in nature and the operation may be controlled by commands from a controller other than that recited.

Each base controller 33 may control the operation of the associated base compressor 22, throttling device 26 and blow-off device 32. For example, base controller 33 can set the operating parameters (desired volume of compressed air, output air pressure, etc.) and command the starting and stopping of base compressor 22, the throttling of input air by throttling device 26 and the venting of excess air production by blow-off device 32. The operating conditions for each base compressor 22 and its associated components may be reported/communicated to master controller 42 by the associated base controller 33. Additionally, master controller 42 may provide commands to each base controller 33 that dictate how each base compressor 22 is operated.

Each trim controller 40 may control the operation of the associated trim compressor 34. For example, trim controller 40 can set the operating parameters (desired volume of compressed air, output air pressure, etc.) and command the starting and stopping of trim compressor 34 and its operating speed. The operating conditions for each trim compressor 34 may be reported/communicated to master controller 42 by the associated trim controller 40. Additionally, master controller 42 may provide commands to each trim controller 40 that dictate how each trim compressor 34 is operated.

Figure 2A:
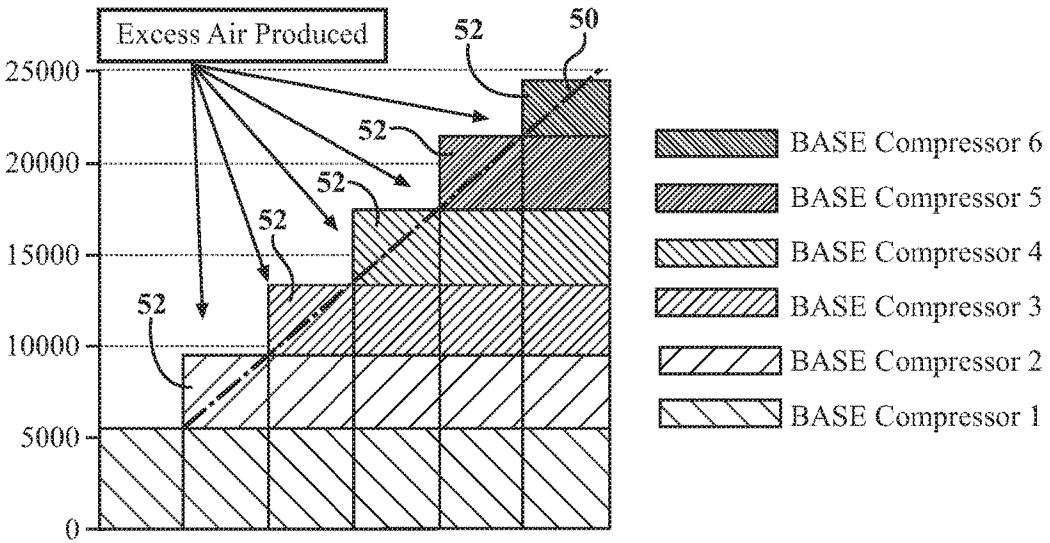
FIG. 2A PRIOR ART
FIGS. 2A and 2B are example graphs respectively illustrating a prior art operation of a compressed air system with only base compressors and possible operation of a compressed air system of FIG. 1 to meet transient demand with base and trim compressors.

Referring now to FIG. 2A, operation of a prior art air system using only base compressors to supply compressed air is shown. The air demand is represented by line 50. One or more base compressors are operated to meet the air demand. As the base compressors have a limited ability to adjust their volume output and supplying less than the needed air demand is not desirable, the total air output typically exceeds the air demand. The excess air production is represented by the volume of air produced that is above demand line 50 and is identified with reference numeral 52. Excess air production is inefficient and results in increased operational costs—both undesirable conditions.

Figure 2B:
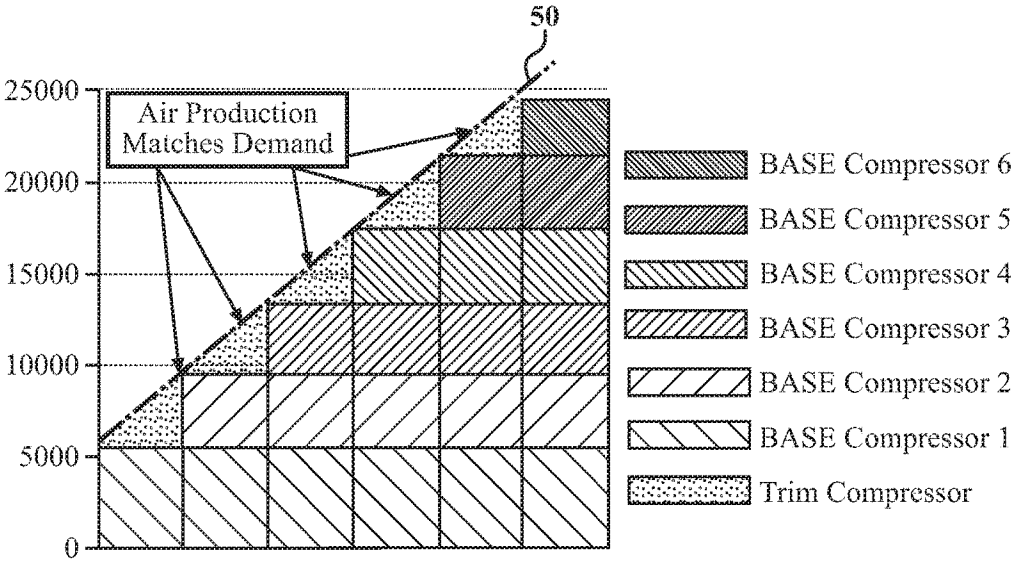

Referring now to FIG. 2B, an exemplary operation of system 20 using both base compressors 22 and a trim compressor 34 is shown. System 20 uses base compressors 22 to meet the majority of the air demand 50 and trim compressor 34 to supplement the production of base compressors 22 to meet air demand 50. Ideally, the total air production of system 20 is controlled to match the air demand 50, however, it should be appreciated that it is preferred to exceed air demand 50 rather than fail to meet it. As can be seen by comparing FIGS. 2A&B, the use of both base compressors 22 and trim compressor 34 can more closely meet air demand 50 versus the use of just base compressors alone. As a result, less waste is produced and more efficient operation may be realized.

Base compressors 22 are an efficient way to provide compressed air at a relatively constant volume at a specific pressure. The output of base compressors 22 can be varied through the use of throttling devices 26 and blow-off devices 32 to try and maintain a constant pressure in distribution network 30, as known in the art. For example, when excess air is being produced by a base compressor 22, which will result in increased air pressure in distribution network 30, throttling device 26 can reduce the air flow into base compressor 22 thereby reducing the output and the resulting contribution to air pressure in distribution network 30. This is also referred to as partial loading. If the pressure is still too high, excess air production can be discharged by the associated blow-off device 32 to further reduce the resulting contribution to air pressure in distribution network 30. However, the use of throttling device 26 (partial loading) and venting via blow-off device 32 are inefficient and increases the operating cost of system 20.

Trim compressors 34 may be more efficient at providing compressed air at a particular volume and pressure as compared to operating a base compressor 22 at partial load and/or venting. Trim compressors 34 may use variable speed motors to modulate their output. The advantage of this is that it allows the compressor to have a relatively linear output (cubic feet per minute) to energy (kilowatt) input efficiency curve compared to other mechanisms such as inlet modulation and load/unload operation. As such, it may be desirable to operate base compressors 22 at a full load (or limited partial loading) and supplement the output with one or more trim compressors 34 to meet the air demands in an overall more efficient manner.

Figures 10, 11:
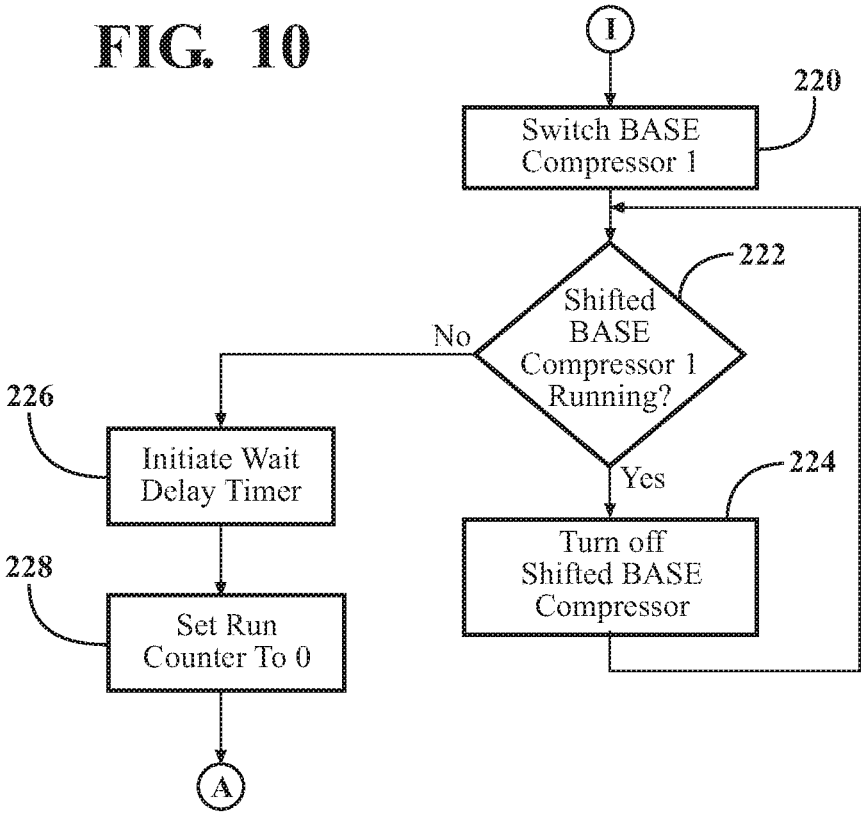
FIG. 11 is an example table showing a possible shifting of base compressors.

In one or more arrangements, system 20 may be operated such that a majority of a relatively stable air demand is met by the use of base compressors 22 and the remaining air demand is met through the use of one or more trim compressors 34 as necessary. System 20 may select which and how many base compressors 22 to utilize to meet the relatively stable air demand and which and how many trim compressors 34 to utilize to supplement base compressors 22 to meet the air demand. System 20 may select the combination of base and trim compressors 22, 34 to meet desired efficiency goals and/or improve overall efficiency. System 20 may use an efficiency metric to determine the combination of base and trim compressors 22, 34. System 20 may select base compressors 22 to even out the overall usage across all of the base compressors 22. For example, as shown in FIG. 11, each base compressor (represented as Compressor A, B, C and D) can be assigned an initial base position (1, 2, 3 and 4). The base position determines the sequence in which the base compressors are to be activated. The assignments may be switched, such as when a running base compressor is stopped, so that the next time a non-running base compressor is commanded to start a different compressor is in the lead position (Base position 1). By balancing the use of each base compressor 22, the longevity may be improved and provide for a more even wear on each base compressor 22. System 20 may dynamically supplement operation of a base compressor 22 with a trim compressor 34 and vice versa as the air demand changes. System 20 may unload a base compressor 22 in increments or steps (controlled unloading) to watch for undesirable changes in the ability to meet the air demand, such as a pressure drop below a predetermined threshold. System 20 may control the timing and/or rate of re-loading a base compressor 22 to avoid undesirable wear and tear and/or damage.

In one or more arrangements, system 20 is controlled to provide a desired volume of compressed air at a desired pressure. The air demand (volume demand) can vary as different machines demand differing air flows from air distribution network 30 as they turn on and off. While the air volume demand may change, the required air pressure at which the air is supplied is typically maintained within a limited range to provide for proper operation of the machines using air from system 20. That is, the machines using compressed air from system 20 are configured to perform their associated tasks with air being supplied at a particular pressure. System 20 may be configured to provide the varying air demands at a relatively constant pressure range. By way of example, the desired operating pressure may be 112 psi+/−0.5 psi in distribution network 30. System 20 may monitor the pressure in distribution network 30 and take corrective actions when the pressure deviates from the desired operating pressure. For example, a low pressure warning may be indicated when the pressure is within a low range below the desired operating pressure, such as between 0.6 and 2.9 psi below, and a low pressure alarm may be indicated when the pressure is a predetermined amount below the desired operating pressure, such as 3.0 psi below or greater. The corrective action taken by system 20 can vary based on whether there is a low pressure warning or a low pressure alarm. For example, when a low pressure warning is present, system 20 may look to increase the output of one or more trim compressors 34, initiate operation of another base compressor 22, and/or replace operation of one or more trim compressors 34 with operation of one or more base compressors 22. When a low pressure alarm is present, system 20 may, by way of example, initiate operation of a trim compressor 34, if available, and/or initiate operation of another base compressor 22. A low pressure alarm may require a more drastic or quicker response than a low pressure warning as the pressure in distribution network 30 may be inadequate to meet the needs of the machines utilizing the compressed air.

In one or more arrangements, system 20 may monitor the amount of excess air being discharged by blow-off devices 32. System 20 may initiate a corrective action if the discharged air exceeds a predetermined quantity. For example, system may determine a collective amount of discharged air from all blow-off devices 32 and compare that to a predetermined value. If the collective amount exceeds the predetermined value, system 20 may determine if a more efficient arrangement of base and trim compressors 22, 34 can be operated to meet air demand. System 20 may look at an efficiency metric to determine if it is more efficient to operate a trim compressor 34 or a base compressor 22. The efficiency metric may take into account the efficiency of a base compressor 22 at both full loading and partial loading and the efficiency of a trim compressor 34 at various operational speeds in making a determination about a preferred operational arrangement. In some operational scenarios, it may be more desirable to run a base compressor 22 at partial loading as opposed to a trim compressor 34 at low operational speed. By way of example, one efficiency metric may be a measure of the amount of energy (kilowatt hours) to make 1000 CFM of air at a given psi, such as 112 psi. This metric may be referred to as a KCF number. System 20 may calculate the KCF for a particular compressor (base or trim) and compare that to a predetermined value to ascertain whether to operate a base compressor 22 or a trim compressor 34. By way of example, if a KCF of operating an available and non-running base compressor 22 is greater than 3.5 then system 20 may replace operation of a trim compressor 34 with that base compressor 22. The available and non-running base compressor 22 may be the next available non-running base compressor 22 in a predetermined usage sequence. It should be appreciated that other efficiency metrics may be utilized and that the metric may be a ratio.

In one or more arrangements, system 20 may operate base compressor 22 and trim compressors 34 so that a running trim compressor 34 is the lead adjuster. For example, system 20 may place a demand on running base compressors 22 that are beyond their capabilities (such as a pressure output greater then operationally possible) thereby ensuring that the running base compressors 22 are fully loaded. Adjustments to the air output system 20 may then be accomplished by adjusting the operational speed of a trim compressor 34 to meet the air demand. This arrangement may prevent a fight between adjusting the loading of a running base compressor 22 and adjusting of the operational speed of a trim compressor 34.

Figure 3:
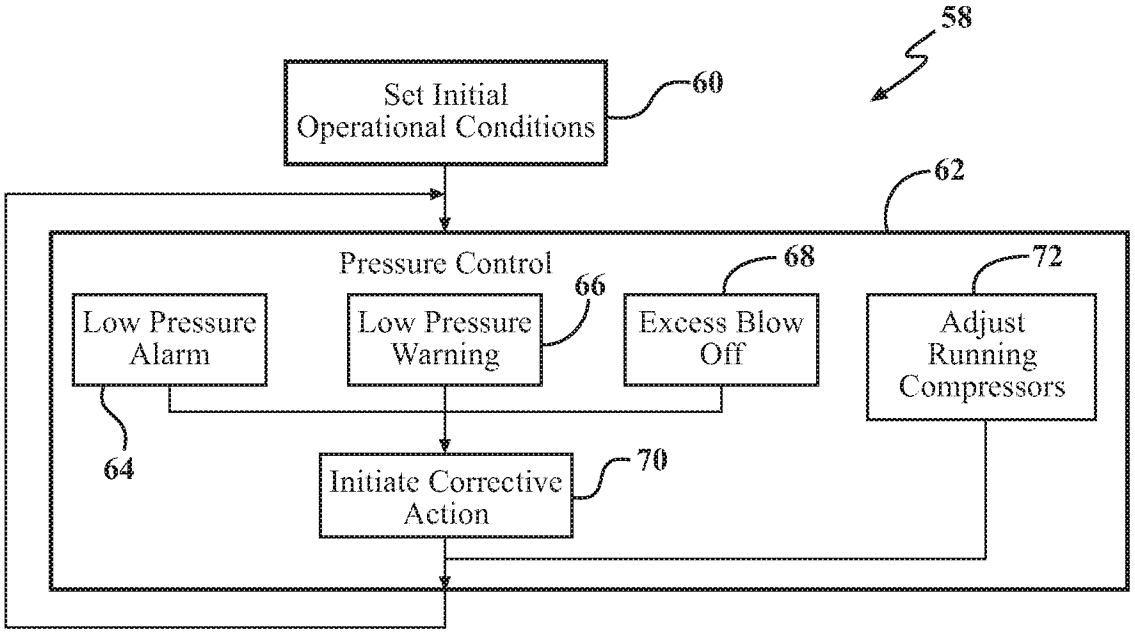
FIG. 3 is an example flow chart illustrating an overview of a possible operation of the compressed air system of FIG. 1 to meet an air demand.

Referring now to FIG. 3, an exemplary overview of a possible control scenario 58 of system 20 is illustrated. Initial operational conditions are set, as indicated in block 60. Initial operational conditions may include the initial air demand in CFM at a particular psi, such as 10,000 CFM at 112 psi by way of non-limiting example. The initial air demand may be based on a previous operational condition, the day of the week, the time during a particular day, a production schedule, etc. With the initial operational conditions set, the pressure control system, as indicated in block 62, begins to operate. Pressure control 62 monitors the operational condition of system 20 and the air demand and adjusts operation of base compressors 22 and trim compressors 34 to meet the air demand. Pressure control 62 determines if there is a low pressure alarm, as indicated in block 64, if there is a low pressure warning, as indicated in block 66 or if there is an excess blow off condition, as indicated in block 68. Pressure control 62 initiates a corrective action, as indicated in block 70, as needed to address a low pressure alarm, a low pressure warning, or an excess blow off condition to achieve a desired operational efficiency while meeting the air demand. If no corrective action is needed, pressure control 62 will adjust the operation of the running base and trim compressors 22, 34 to meet the air demand, as indicated in block 72. By way of example, in block 72 pressure control 62 may adjust the operational speed of running trim compressors 34 to meet the air demand while maintaining the running base compressors 22 fully loaded. The running trim compressor(s) 34 thereby lead the adjustment as its associated trim controller 40 varies the speed to achieve the air demand and the targeted air pressure in distribution network 30. If there is no running trim compressors 34, pressure control 62, through the associated base controllers 33, may load/unload the operating base compressors 22 and/or adjust the blow off to meet the air demand and maintain the targeted air pressure.

Figure 4:
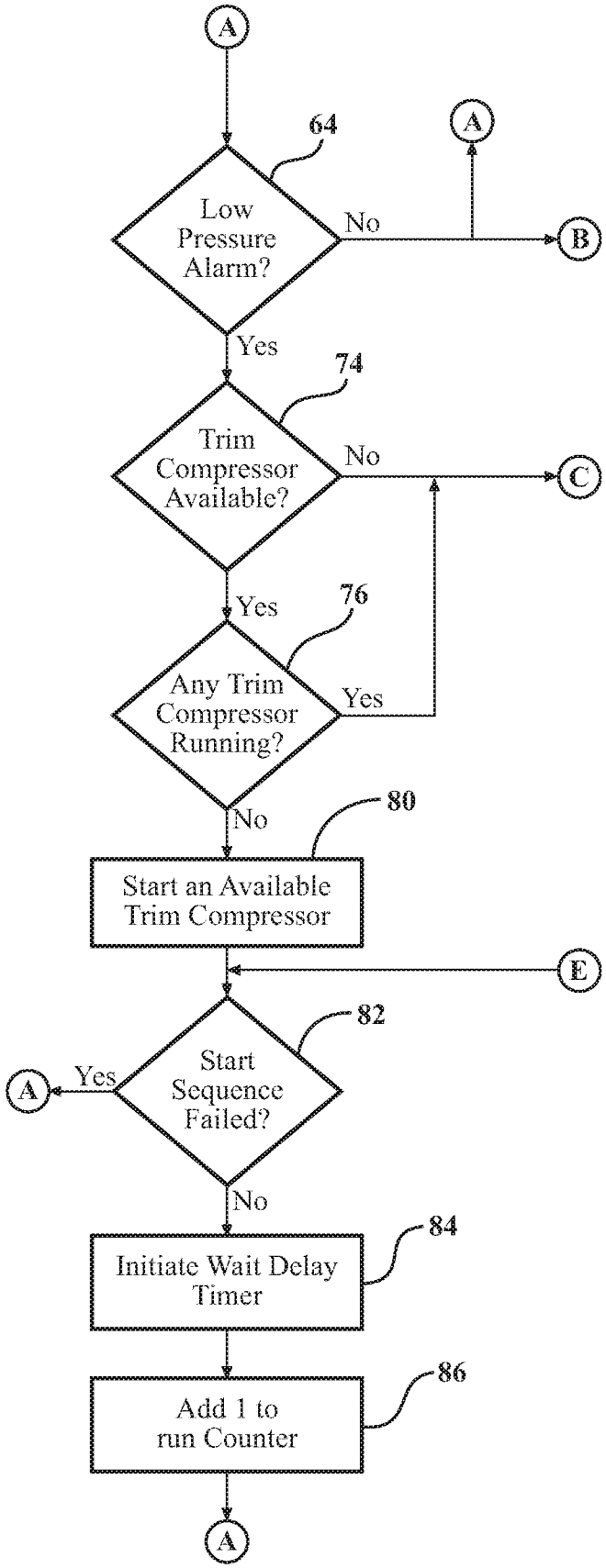
FIGS. 4-10 are example flow charts illustrating possible operation of the compressed air system of FIG. 1 to meet an air demand.

Referring now to FIGS. 4-10, an exemplary operation of pressure control 62 is illustrated. Pressure control 62 begins at step A, as shown in FIG. 4. Pressure control 62 monitors the air pressure in distribution network 30 and compares the air pressure to a threshold. If the pressure is below a target value or threshold, a low pressure alarm is activated, as indicated in decision block 64. If the low pressure alarm is not activated, pressure control 62 will move onto step B in FIG. 5 and also back to step A. Thus, pressure control 62 may continuously check for a low pressure alarm condition. Any time a low pressure alarm is activated, availability of a trim compressor 34 is determined, as indicated in decision block 74. If a trim compressor 34 is not available, pressure control 62 will move onto step C in FIG. 6. If a trim compressor 34 is available, pressure control 62 will determine if any trim compressor 34 is currently running, as indicated in decision block 76. If a trim compressor 34 is running, pressure control 62 will move onto step C in FIG. 6. Moving onto step C in FIG. 6 will result in initiating operation of a base compressor 22 instead of another trim compressor 34. If a trim compressor 34 is not running, pressure control 62 initiates operation of an available trim compressor 34, as indicated in block 80. To initiate operation, master controller 42 will command operation of a trim compressor 34 at a particular operational speed to meet the air demand.

Pressure control 62 will then determine if the commanded start sequence failed, as indicated in decision block 82. If the start sequence failed, pressure control 62 will return to step A. If the run sequence did not fail, pressure control 62 will initiate a wait delay timer, as indicated in block 84. The wait delay timer stops further operation of pressure control 62 until the predetermined time period has lapsed. The wait delay timer prevents rapid operation of pressure control 62 and allows time for the operational changes to have some effect. Wait delay timer, by way of non-limiting example, may be about 30 seconds. Upon the completion of the wait delay timer, pressure control 62 will add 1 to a run counter, as indicated in block 84. The run counter is used to allow operation of system 20 to stabilize and prevent immediate corrective action in the event of a low pressure warning condition, as explained further below. The run counter does not prevent pressure control 62 from initiating another corrective action to address a low pressure alarm situation or an excess blow off condition. After adding 1 to the run counter, pressure control 62 returns to step A.

Figure 5:
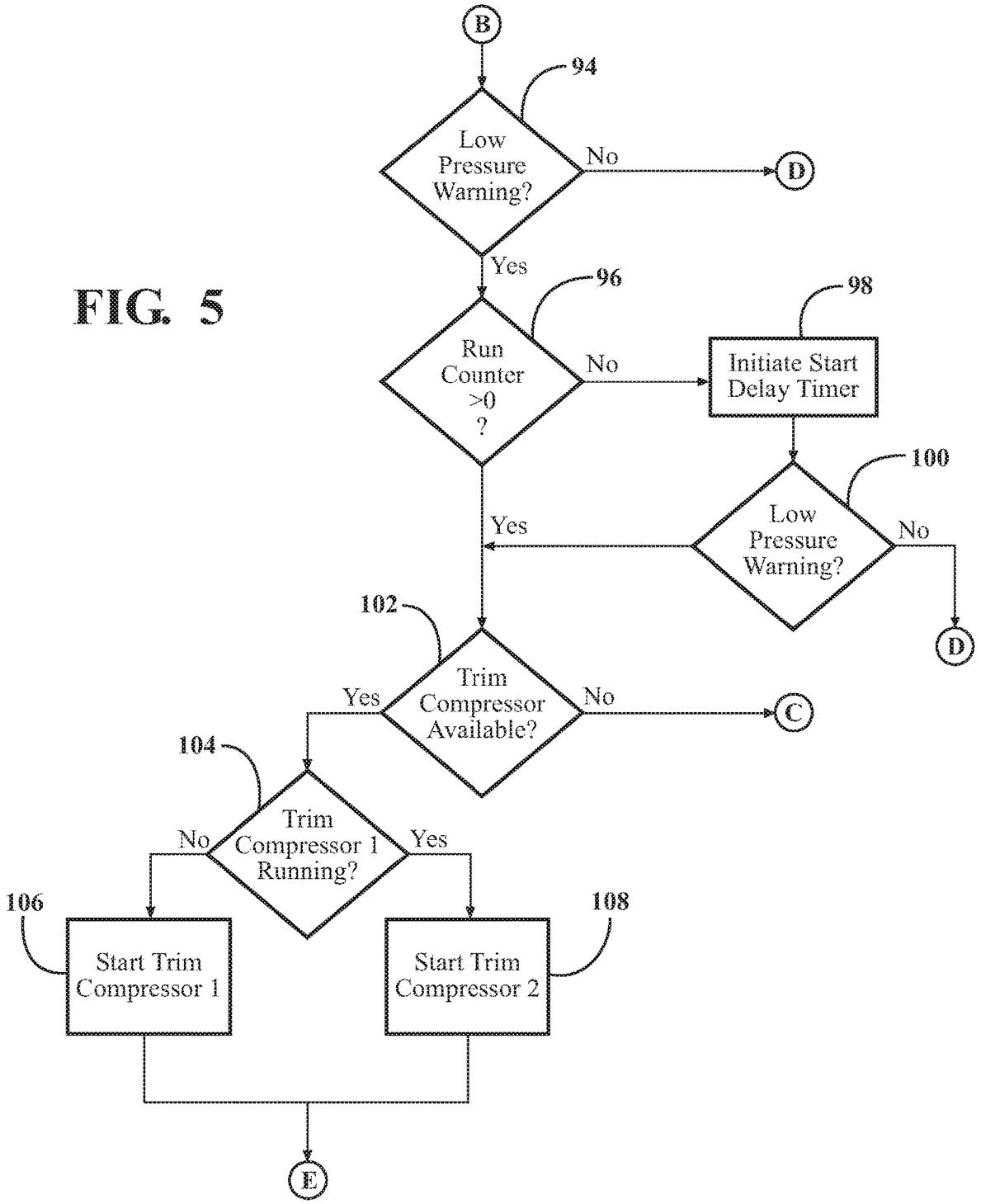

Referring now to FIG. 5, step B is illustrated. At step B, pressure control 62 will determine if a low pressure warning is active, as indicated in decision block 94. If a low pressure warning is not active, pressure control 62 moves to step D in FIG. 7. If a low pressure warning is active, pressure control 62 determines if the run counter is greater than 0, as indicated in decision block 96. If the run counter is not greater than 0, pressure control 62 initiates a start delay timer, as indicated in block 98. The start delay timer prevents a corrective action due to a low pressure warning from occurring until after the predetermined time period has been completed. The delay allows the air demand to stabilize prior to initiating operation of another compressor due to a low pressure warning. By way of example, the start delay timer may be 30 minutes. The run counter is set at 0 upon initial activation of pressure control 62 and is only greater than 0 if a corrective action due to a low pressure alarm has already occurred. Thus, the first time a low pressure warning condition is encountered, the start delay timer will allow the air demand to stabilize prior to initiating a corrective action.

Upon the completion of the start delay timer, pressure control 62 again determines if a low pressure warning is active, as indicated in decision block 100. If there is no low pressure warning, pressure control 62 moves to step D in FIG. 7. If there is a low pressure warning, pressure control 62 then determines if a trim compressor 34 is available, as indicated in decision block 102. If a trim compressor 34 is not available, pressure control 62 moves to step C in FIG. 6. If a trim compressor 34 is available, pressure control 62 determines if trim compressor 1 is running, as indicated in decision block 104. If trim compressor 1 is not running, pressure control 62 initiates operation of trim compressor 1, as indicated in block 106. If trim compressor 1 is running, pressure control 62 initiates operation of trim compressor 2, as indicated in block 108. After initiating operation of trim compressor 1 or 2, pressure control 62 moves to step E in FIG. 4 and continues as discussed above. Thus, upon the occurrence of a low pressure warning, pressure control 62 may initiate a corrective action through the initiating of an available trim compressor as opposed to a base compressor to meet the air demand. It should be appreciated that pressure control 62 was described with reference to only two trim compressors and if more than two trim compressors where present pressure control 62 could initiate those additional trim compressors to attempt to meet the air demand before initiating another base compressor.

Figure 6:
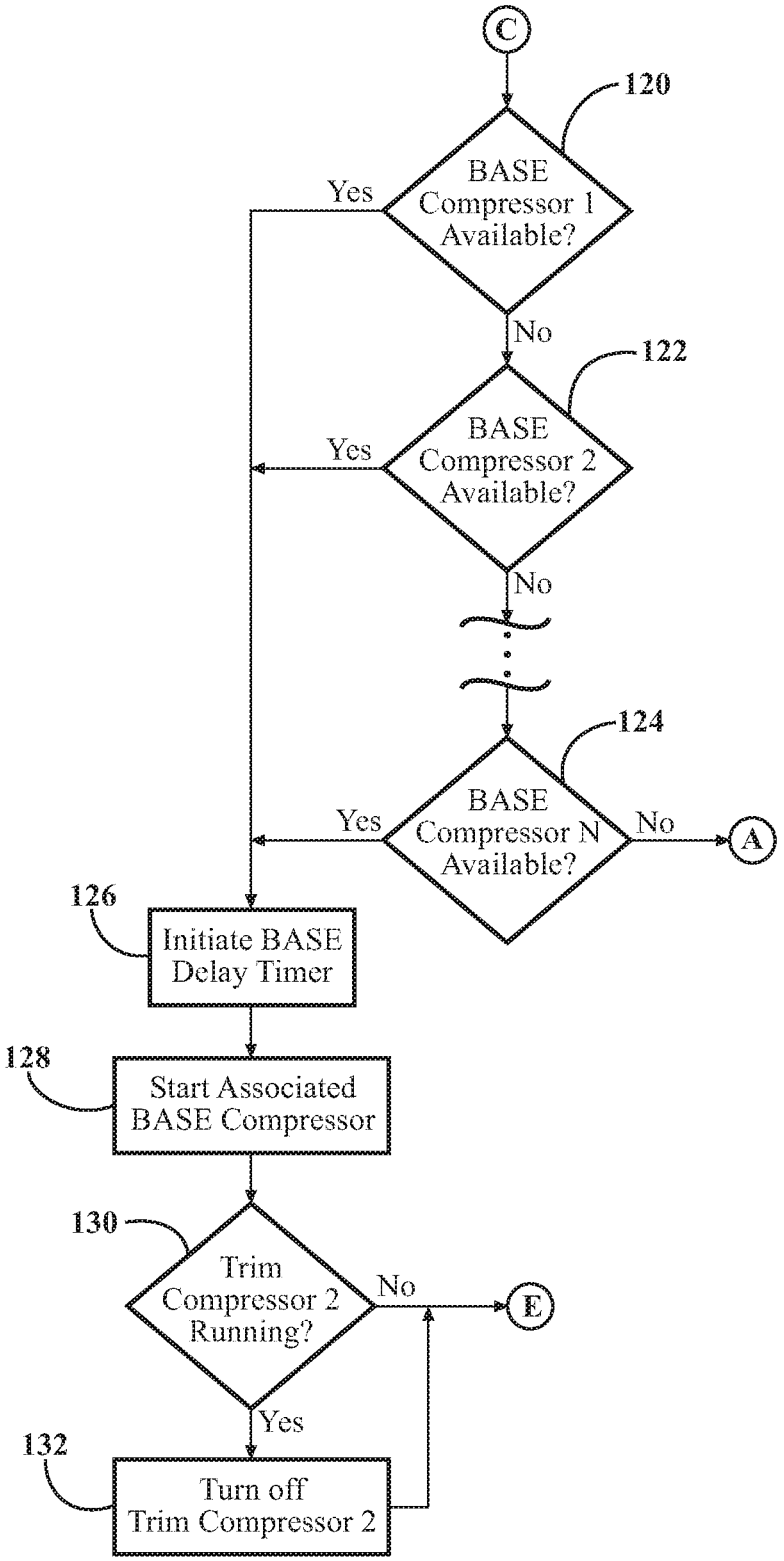

Referring now to FIG. 6, the corrective action of pressure control 62 during a low pressure alarm or a low pressure warning condition when there are not any available trim compressors is illustrated. At step C, pressure control 62 determines if base compressor 1 is available, as indicated in decision block 120. If base compressor 1 is not available, pressure control 62 determines is base compressor 2 is available, as indicated in decision block 122. If base compressor 2 is not available, pressure control 62 will continue to ascertain if the next compressor in the sequence (e.g., 3, 4, . . . N) is available up until pressure control 62 finds an available base compressor, as indicated in decision block 124. If there is no available base compressor pressure control 62 returns to step A in FIG. 4. The situation where there is no available base compressor may correspond to the air demand exceeding the capabilities of system 20.

Once an available base compressor 22 has been ascertained, pressure control 62 initiates a base delay timer, as indicated in block 126. Base delay timer prevents pressure control 62 from initiating operation of a base compressor 22 for a predetermined time period. By way of example, base delay timer may be 1 minute. After completion of base delay timer, pressure control 62 will command the operation of the associated available base compressor (base compressor available from decision blocks 120-124), as indicated in block 128. Pressure control 62 will then ascertain if trim compressor 2 is running, as indicated in decision block 130. If trim compressor 2 is running, pressure control 62 will command operation of trim compressor 2 to stop, as indicated in block 132. If trim compressor 2 is not running or once trim compressor 2 has been commanded to stop, pressure control 62 will move to step E in FIG. 4.

Thus, as illustrated in FIGS. 5 and 6, in the event of a low pressure warning, pressure control 62 may attempt to meet the air demand by initiating operation of an available trim compressor 34, up to two trim compressors 34 in the system illustrated. If the operation of the trim compressors 34 is insufficient then pressure control 62 will initiate operation of one or more available base compressors 22. When an available base compressor 22 is started, if there are two running trim compressors 34, one of those trim compressors 34 may be shut down.

Figure 7:
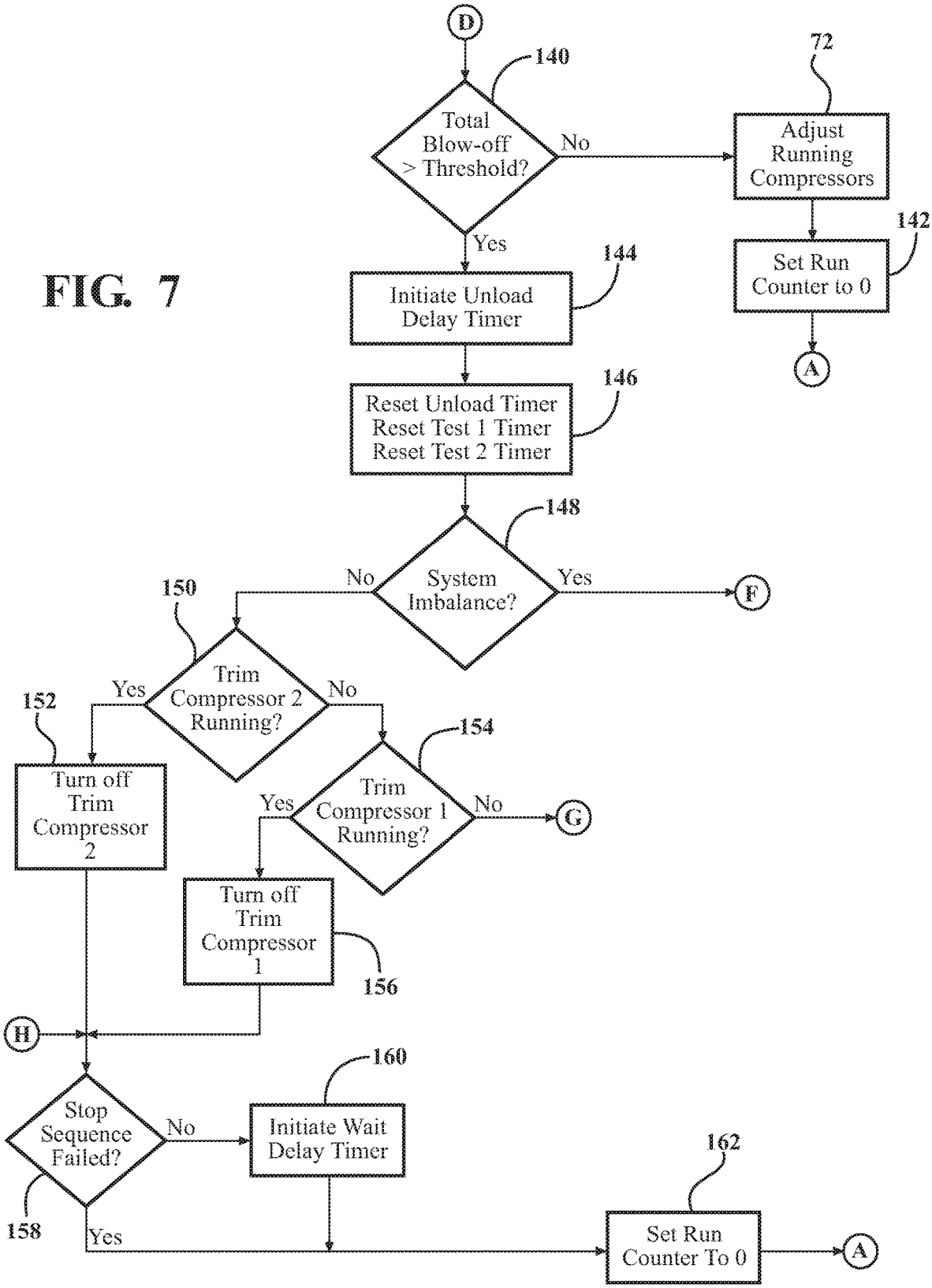
Figure 8:
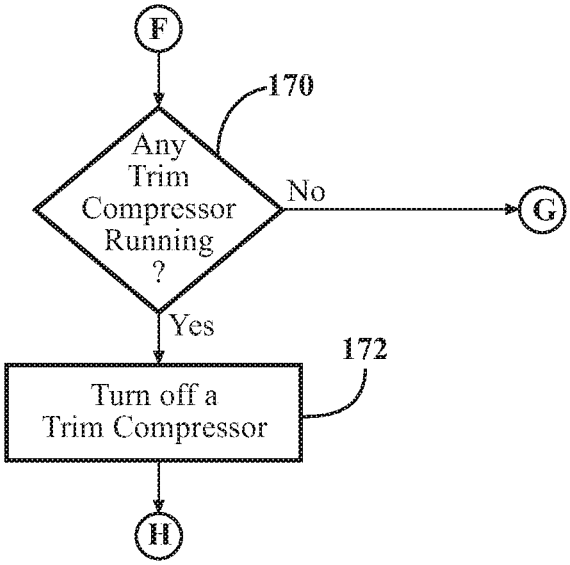
Figure 9:
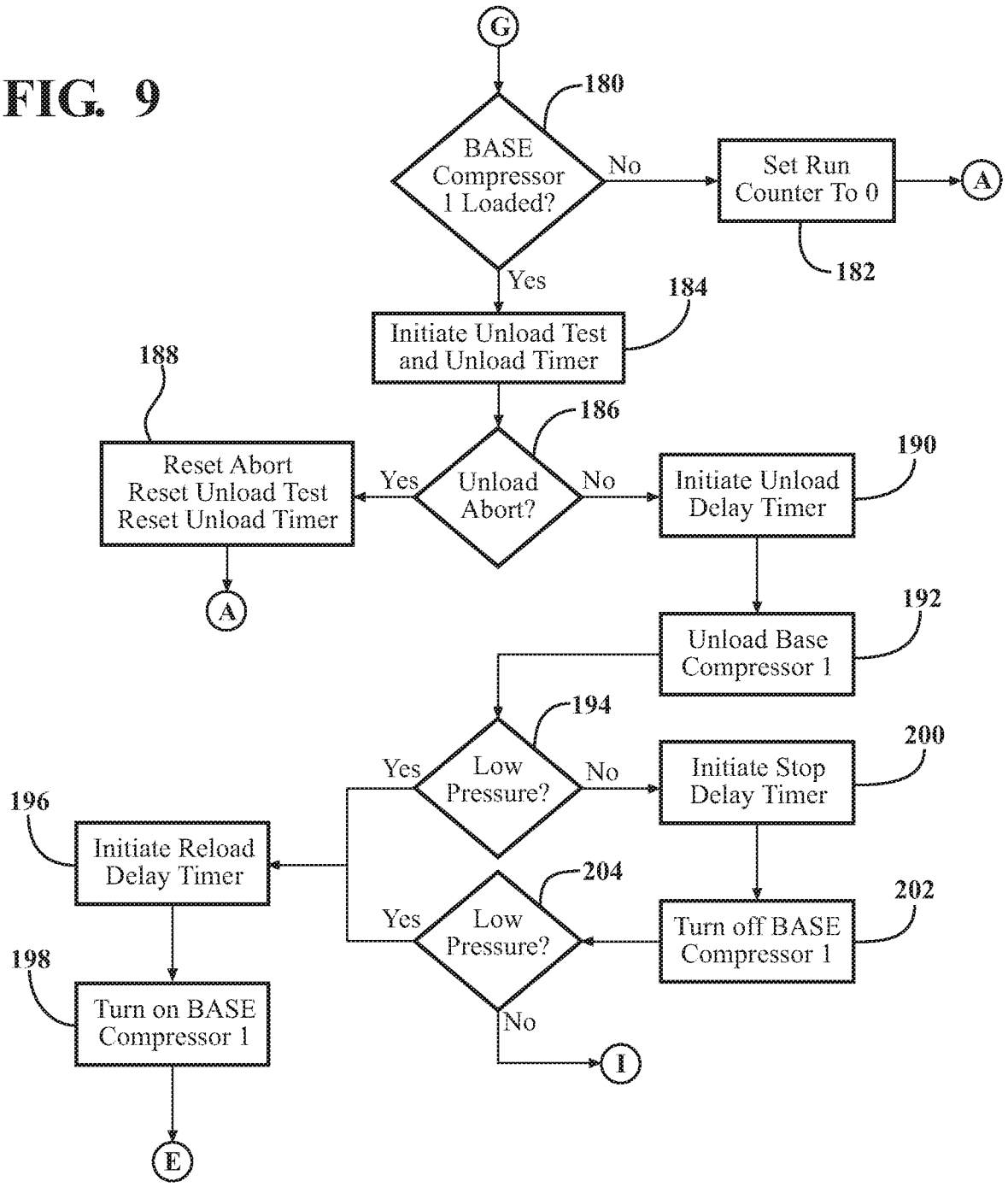

Referring now to FIGS. 7-9, corrective action of pressure control 62 during an excess blow off condition is illustrated. In step D, pressure control 62 ascertains if the total blow-off is greater than a threshold value, as indicated in decision block 140. If the total blow-off is less than the threshold, pressure control 62 then adjusts the running compressor(s), as indicated in block 72, sets the run counter to 0, as indicated in block 142 and returns to step A in FIG. 4. If the total blow-off is greater than the threshold, pressure control 62 initiates an unload delay timer, as indicated in block 144. The unload delay timer provides for a time delay prior to turning off a trim compressor 34 or unloading a base compressor 22, as described below. By way of example, the unload delay timer may be about 1 minute. Once the unload delay timer is complete, pressure control 62 resets an unload test counter, an unload test 1 timer and an unload test 2 timer, as indicated in block 146. Following the reset, pressure control 62 then determines if there is a system imbalance, as indicated in decision block 148. The determination of a system imbalance may be a determination of whether it is more desirable to run a base compressor 22 instead of a trim compressor 34. For example, pressure control 62 can determine the KCF of the next available base compressor, such as by looking at the table of FIG. 11, and compare the KCF to a threshold value to make the determination. If it is more desirable to run a base compressor instead of continuing to run a trim compressor, pressure control 62 will indicate that the there is a system imbalance and move to step F in FIG. 8.

If there is not a system imbalance, pressure control 62 will look to turn off a trim compressor 34 if possible. Pressure control 62 will determine if trim compressor 2 is running, as indicated in decision block 150, and if trim compressor 2 is running pressure control 62 will command that operation of trim compressor 2 be stopped, as indicated in block 152. If pressure control 62 determines that trim compressor 2 is not running, pressure control 62 will determine if trim compressor 1 is running, as indicated in decision block 154, and if trim compressor 1 is running pressure control 62 will command that operation of trim compressor 1 be stopped, as indicated in block 156. In the event that neither trim compressor 2 nor trim compressor 1 is running, pressure control 62 will move to step G in FIG. 9 to turn off a base compressor 22, as described below. If either trim compressor 1 or 2 is commanded to stop operation, pressure control 62 will check if the stop sequence failed, as indicated in decision block 158. If the stop sequence was successful, pressure control 62 will initiate a wait delay timer, as indicated in block 160. By way of example, the wait delay timer in block 160 may be the same as the wait delay timer in block 84. Once the wait delay timer is completed or if the stop sequence failed, pressure control 62 will set the run counter to 0, as indicated in block 162 and return to step A in FIG. 4.

Referring now to FIG. 8, the action of pressure control 62 in the situation where a system imbalance was determined in decision block 48 is illustrated. Pressure control 62 will determine if any trim compressor 34 is running, as indicated in decision block 170. If there are not any trim compressors 34 running, pressure control 62 will move to step G in FIG. 9 to turn off a base compressor 22, as described below. If a trim compressor 34 is running, pressure control 62 will command that the operation of a running trim compressor 34 be stopped, as indicated in block 172, and then move to step H in FIG. 7 and proceed as described above. By stopping the trim compressor 34 to address an imbalance situation, pressure control 62 when reaching step A and repeating going through the various steps will determine if a base compressor 22 needs to be started to meet the air demand or if all trim compressors 34 are inactive will adjust operation of a running base compressor(s) 22 to meet the air demand.

Referring now to FIG. 9, addressing an excess blow-off condition when there are not any trim compressors 34 running is illustrated. In this case, pressure control 62 will look to unload a running base compressors 22 and verify that the unloading does not cause detrimental system performance. Pressure control 62, as indicated in decision block 180 will ascertain if base compressor 1 (base position 1 in the table of FIG. 11) is loaded. If there are any base compressors 22 running, then base compressor 1 will be loaded as it is the first base compressor to have been started when system 20 was turned on to meet the air demand. If base compressor 1 is not loaded, pressure control 62 will set the run counter to 0, as indicated in block 182, and return to step A in FIG. 4. If base compressor 1 is loaded, pressure control 62 will initiate an unload test and an unload timer, as indicated in block 184, which will run simultaneously. The unload timer will set a minimum time frame for which to test the unloading. By way of example, the unload timer may be about 5 minutes. The unload test will begin unloading base compressor 1 in stepped increments. By way of example, the unload test may reduce the loading on base compressor 1 by reducing the target output pressure in 0.5 psi increments every minute. Pressure control 62 will monitor and count the pulses in the output pressure of base compressor 1 to make sure that each stepped reduction was completed prior fully unloading base compressor 1. For example, pressure control 62 can use the duration of the unload timer and the frequency of stepped reductions to determine how many pulses should be realized, in this case 5 pulses (1 each minute over a 5 minute span). During the running of the unloading test and unload timer, pressure control 62 monitors the air pressure in distribution network 30 to make sure that an unload abort condition (low pressure alarm) does not occur. An unload abort condition indicates the contribution of base compressor 1 is needed to meet the air demand and it should not be unloaded. If an unload abort condition is determined, as indicated in decision block 186, pressure control 62 will reset the unload test (stops the unload test), the unload timer, and the abort alarm, as indicated in block 188. This should return the operation of base compressor 1 back to its nominal running state prior to initiating the unloading test. Pressure control 62 then returns to step A in FIG. 4.

If an unload abort condition does not occur and upon the completion of the unload test and unload timer, pressure control 62 will initiate an unload delay timer, as indicated in block 190. The unload delay timer provides a delay prior to beginning the full unloading of base compressor 1. By way of example, the unload delay timer may be 3 to 5 minutes. Upon the completion of the unload delay timer, pressure control 62 will initiate unloading of base compressor 1, as indicated in block 192. To initiate the unloading, pressure control 62 can command that the operation of base compressor 1 be stopped with the intent of reaching a fully unloaded and de-energized condition. Pressure control 62 monitors the pressure in distribution network 30 during the unloading and ascertains if a low pressure warning or alarm is activated, as indicated in decision block 194. Activation of a low pressure warning or alarm is indicative of the need for the operation of base compressor 1 to meet the air demand. If a low pressure warning or alarm is activated, pressure control 62 initiates a reload delay timer, as indicated in block 196. The reload delay timer delays the re-energizing of base compressor 1 to allow the motor to fully stop and avoid damage by re-energizing too soon. By way of example, the reload delay timers may be about 15-30 seconds. Upon completion of the reload delay timer, pressure control 62 commands the operation of base compressor 1, as indicated in block 198, and then moves to step E in FIG. 4.

If pressure control 62 determines that there is not a low pressure situation, as indicated in decision block 194, a stop delay timer is initiated, as indicated in block 200. The stop delay allows for a delay before pressure control 62 turns off base compressor 1. When the stop delay is timer is completed, pressure control 62 turns off base compressor 1, as indicated in block 202, and again ascertains if a low pressure warning or alarm condition exists, as indicated in decision block 204. If a low pressure situation exists, pressure control 62 moves to block 196 and proceeds as discussed above to rectify the condition. If a low pressure condition does not exist, as determined in decision block 204, pressure control 62 moves to step I in FIG. 10 to shift or change the assignments of the compressors in the table of FIG. 11.

Referring now to FIGS. 10 and 11, the shifting or changing of the compressor assigned to the various base positions is illustrated. When pressure control 62 gets to step I, the base compressor positions are switched, as indicated in block 220. Pressure control 62 will move the compressor currently assigned to position 1 to the lowest position and shift the remaining compressor up one spot in the positioning. For example, in the case where there are four base positions (1 to 4) and there are four base compressors (A to D), the initial assignment upon start up of system 20 has the four positions (1 to 4) assigned to the respective four compressors (A to D). Upon pressure control 62 executing a first switch (first time executing block 220), compressor A will move from position 1 to position 4 and compressors B to D will each move up to the respective positions 1 to 3. Upon the next subsequent switch, compressor B will move from position 1 to position 4 with compressors C, D and A moving to respective positions 1 to 3. Because pressure control 62, when initiating operation of a non-running base compressor begins by looking at position 1 first and moving downward to position 4, as illustrated in FIG. 6, the most recently de-activated base compressor will be at the bottom of the list. This re-sequencing of the base compressors 22 can even out the usage across all of the base compressors thereby sharing the burden of supplying compressed air. The initial assignments may be based on the assignments when system 20 was last shut down or may be manually selected at desired intervals or upon the occurrence of particular events, such as when a compressor is overhauled or repaired by way of example.

Upon completion of the switching, pressure control 62 will determine if the shifted base compressor 1 (the compressor that moved from position 1 to position 4 in this example) is still running, as indicated in decision block 222. If the shifted base compressor 1 is still running, pressure control 62 will again command its operation to stop, as indicated in block 224. Once pressure control 62 determines that shifted base compressor 1 is not running, a wait delay timer is initiated, as indicated in block 226. The wait delay timer may the same as that discussed above with reference to block 160. Upon completion of the wait delay timer, pressure control 62 sets the run counter to 0, as indicated in block 228, and returns to step A in FIG. 4.

It will be appreciated that arrangements described herein can provide numerous benefits, including one or more of the benefits mentioned herein. For example, arrangements described herein can provide for a distribution of the loading across multiple base compressors. Additionally, the system can choose between the use of a trim compressor or a base compressor by using a metric, which may be related to efficiency and which may not necessarily be limited to only selecting the most efficient arrangement. Moreover, the system can selectively remove a base compressor by unloading the base compressor in stages to ascertain if undesirable operation results from the removal. Thus, the various arrangements may provide numerous benefits.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means ..plus-function format and are not intended to be interpreted based on 35 U.S.C. 112, sixth paragraph, unless and until such claim limitations expressly use the phrase "means for" followed by a statement of function void of further structure. The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC). The term "operatively connected" as used throughout this description, can include direct or indirect connections, including connections without direct physical contact.

Aspects herein can be embodied in other forms without departing from the spirit or essential attributes thereof. Accordingly, reference should be made to the following claims, rather than to the foregoing specification, as indicating the scope of the invention.

What is claimed is:

1. A compressed air system comprising:

an air distribution network;

a plurality of fixed speed drive base compressors, each base compressor having an air outlet coupled to the air distribution network and operable to independently supply a flow of pressurized air to the air distribution network;

at least one variable speed drive trim compressor having an air outlet coupled to the air distribution network and operable to independently supply a flow of pressurized air to the air distribution network; and a control system coupled to the air distribution network, the base compressors, and the at least one trim compressor, the control system monitoring the pressure of the air distribution network and controlling the operation of the base compressors and the at least one trim compressor to meet an air demand placed on the air distribution network;

wherein when the control system determines that there is excess air production and seeks to stop operation of a base compressor, the control system initiates a pre-unloading unload test for an operating base compressor, the unload test including reducing the output pressure of the operating base compressor by a predetermined increment in a series of steps and, at each step, monitoring the pressure of the air distribution network and confirming the reductions by counting a pulse in the output pressure of the operating base compressor, the control system unloading the operating base compressor only when the reductions are confirmed and the pressure of the air distribution network remains above the a predetermined threshold, and maintaining operation of the operating base compressor when the reductions are not confirmed or the pressure of the air distribution network drops below the predetermined threshold.

2. The compressed air system of claim 1, wherein the predetermined increment is about 0.5 psi.

3. The compressed air system of claim 1, wherein when the control system initiates the unload test, an unload timer is also initiated and operation of the associated base compressor cannot be stopped prior to completion of the unload timer.

4. The compressed air system of claim 1, wherein the base compressors are arranged an in initial use order that determines the order in which the base compressors will be activated by the control system, and upon the deactivation of one of the base compressors, the order in which the base compressors will be activated by the control sysetm is changed.

5. The compressed air system of claim 4, wherein the order in which the base compressors will be activated by the control sysetm is changed by moving the deactivated base compressor to the bottom of the order and shifting the remainder of the base compressors up one place in the order.

6. The compressed air system of claim 4, wherein the initial use order is re-set on a predetermined interval.

7. The compressed air system of claim 1, wherein the control system replaces operation of one of the base compressors or the at least one trim compressor with operation of a respective trim compressor or base compressor when an efficiency metric exceeds a predetermined value.

8. The compressed air system of claim 7, wherein:

each base compressor has an air inlet with a throttling device and an associated blow-off device coupled to the air outlet; and the control system deactivates one of the base compressors based upon a total amount of air discharged by the blow-off devices exceeding predetermined quantity.

9. The compressed air system of claim 7, wherein the efficiency metric is a measure of the kilowatt hours to make a predetermined cubic feet of air per a of unit time at a predetermined pressure for at least one of an unused base compressor and an operating trim compressor.

10. The compressed air system of claim 7, wherein the base compressors during nominal operation are commanded to produce an output pressure greater than possible thereby maintaining the base compressors fully loaded during nominal operation.

11. The compressed air system of claim 1, wherein the at least one trim compressor is a screw compressor.

12. The compressed air system of claim 1, wherein the plurality of base compressors includes base compressors of differing capacities for a particular discharge pressure.

13. The compressed air system of claim 7, wherein the control system replaces operation of the at least one trim compressor with a base compressor when the efficiency metric exceeds the predetermined value.

14. The compressed air system of claim 13, wherein the efficiency metric exceeds the predetermined value while the at least one trim compressor is operating below full output capacity.

15. The compressed air system of claim 13, wherein the control system replaces operation of the at least one trim compressor with a base compressor only when a total blow-off of the compressed air system exceeds a predetermined quantity.

16. The compressed air system of claim 1, wherein the base compressors are multi-stage centrifugal compressors.

* * * * *